US007924255B2

(12) United States Patent
Hsu et al.

(10) Patent No.: US 7,924,255 B2
(45) Date of Patent: Apr. 12, 2011

(54) GATE DRIVING METHOD AND CIRCUIT FOR LIQUID CRYSTAL DISPLAY

(75) Inventors: Wen-Fa Hsu, Taoyuan (TW); Chien-Yu Yi, Taoyuan (TW)

(73) Assignee: AU Optronics Corp., Hsinchu (TW)

( * ) Notice: Subject to any disclaimer, the term of this patent is extended or adjusted under 35 U.S.C. 154(b) by 947 days.

(21) Appl. No.: 11/110,088

(22) Filed: Apr. 19, 2005

(65) Prior Publication Data

US 2006/0092109 A1 May 4, 2006

(30) Foreign Application Priority Data

Oct. 28, 2004 (TW) ..... 93132699 A

(51) Int. Cl.
*G09G 3/36* (2006.01)

(52) U.S. Cl. ..... 345/94; 345/87; 345/98; 345/99; 345/100; 345/92; 345/204; 345/205

(58) Field of Classification Search ..... 345/87, 345/204, 94, 100, 208, 55
See application file for complete search history.

(56) References Cited

U.S. PATENT DOCUMENTS

| | | | | |
|---|---|---|---|---|
| 5,995,075 | A * | 11/1999 | Vignolle | 345/94 |
| 6,229,531 | B1 * | 5/2001 | Nakajima et al. | 345/205 |
| 6,329,976 | B1 * | 12/2001 | Johnson et al. | 345/101 |
| 6,359,607 | B1 * | 3/2002 | Yanagi et al. | 345/94 |
| 6,421,038 | B1 * | 7/2002 | Lee | 345/98 |
| 6,492,970 | B1 * | 12/2002 | Furuhashi et al. | 345/94 |
| 6,727,877 | B2 * | 4/2004 | Itakura | 345/94 |
| 6,897,908 | B2 * | 5/2005 | Lee et al. | 349/43 |
| 6,909,415 | B2 * | 6/2005 | Kumagawa et al. | 345/92 |
| 6,927,755 | B2 * | 8/2005 | Chang | 345/101 |
| 6,943,786 | B1 * | 9/2005 | Birk et al. | 345/204 |
| 7,002,542 | B2 * | 2/2006 | Lee | 345/94 |
| 7,102,606 | B2 * | 9/2006 | Miyajima et al. | 345/92 |
| 7,106,291 | B2 * | 9/2006 | Yoon | 345/98 |
| 7,166,034 | B2 * | 1/2007 | Hines et al. | 473/137 |
| 7,304,626 | B2 * | 12/2007 | Yanagi et al. | 345/94 |
| 7,327,338 | B2 * | 2/2008 | Moon | 345/87 |
| 2001/0028337 | A1 * | 10/2001 | Wu et al. | 345/100 |
| 2001/0033266 | A1 * | 10/2001 | Lee | 345/94 |

FOREIGN PATENT DOCUMENTS

JP 06110035 A * 4/1994

* cited by examiner

*Primary Examiner* — Alexander S Beck
*Assistant Examiner* — Grant D Sitta
(74) *Attorney, Agent, or Firm* — J.C. Patents

(57) ABSTRACT

A gate driving method for a liquid crystal display (LCD) and a gate driver thereof are provided. The LCD has a plurality of scan lines. The method starts by generating a gate driving signal. A correction signal is superposed to the gate driving signal to generate a corrected gate driving signal and to reduce a high voltage level of the gate driving signal, wherein a polarity of the correction signal is opposite to a polarity of the gate driving signal. The corrected gate driving signal is then outputted to drive one of the corresponding scan lines.

3 Claims, 7 Drawing Sheets

GATE DRIVING METHOD AND CIRCUIT FOR LIQUID CRYSTAL DISPLAY

CROSS-REFERENCE TO RELATED APPLICATION

This application claims the priority benefit of Taiwan application serial no. 93132699, filed on Oct. 28, 2004. All disclosure of the Taiwan application is incorporated herein by reference.

BACKGROUND OF THE INVENTION

1. Field of the Invention

The present invention relates to an improved method for driving a liquid crystal display, and more particularly to a method of reducing flickers and a method of increasing charging time of a liquid crystal display.

2. Description of the Related Art

Liquid crystal displays (LCDs) have become popular in recent years. Not only can LCDs save spaces, but power consumption can also be reduced. LCDs with large sizes and high resolutions have replaced traditional displays, such as cathode radiation tube displays. Large-size LCDs, however, have a serious issue. The larger the screens of LCDs, the more serious the flicker on the screens of LCDs.

FIG. 1 is a configuration showing a basic structure of an LCD. The gate driver 102 turns on or off the thin film transistor (TFT). The source driver 101 outputs data to a liquid crystal capacitor so that the voltage supplied to the liquid crystal capacitor reaches a desired level when the TFT is turned on.

Traditionally, the gate driver IC 102*a* of the LCD outputs control signals to turn on the TFTs sequentially. The source driver IC 101*a* then outputs the data to the liquid crystal capacitors. Due to the inherent characteristics of the LCD, the flicker would occur while display images.

FIG. 2 is a schematic configuration of a subpixel in a LCD panel. Generally, a LCD subpixel comprises a switch device, such as a TFT, a liquid crystal capacitor $C_{LC}$, and a holding capacitor $C_{st}$, which are both coupled to the TFT. A plurality of subpixels constitute a row-and-column array. Gates G of subpixels in the same column are coupled to a scan line, and sources S of subpixels in the same row are coupled to a data line. As shown in FIG. 2, when the n-th scan line $G_n$ is selected, the gate driver IC of the LCD outputs the control signal to the n-th scan line $G_n$, i.e., to the gate G of the TFT. The data signal waveform is transmitted to the n-th data line Sn. The TFT then is turned on, and the data is transmitted from the source S of the TFT to the drain D of the TFT to charge the liquid crystal capacitor $C_{LC}$ and the holding capacitor $C_{st}$. According to the voltage across the liquid crystal capacitor $C_{LC}$, the subpixel displays the gray level of the subpixel for displaying image. The holding capacitor $C_{st}$ maintains the voltage across the liquid crystal capacitor $C_{LC}$ during the displaying cycle.

The outputted control signal waveform shown in FIG. 2 is a square waveform. During the LCD semiconductor manufacturing process, stray capacitance and resistance are generated on the scan line, which causes RC delay and eventually results in the distortion of the waveform. FIG. 3A is a configuration showing a control signal waveform outputted from a gate driver IC of the LCD. In FIG. 3A, $V_{GH}$ and $V_{GL}$ represent a high voltage level and a low voltage level of the control signal waveform, respectively. $\Delta V_{GH}$ represents the difference between the high voltage level and the low voltage level. FIG. 3B is a configuration showing a distorted waveform after the influence of the stray capacitance and resistance on the scan line. FIG. 3C is a configuration showing a waveform at the end portion of the scan line. $V_1$ represents the high voltage level after waveform distortion, and $\Delta V_1$ represents the difference between the high voltage level and the low voltage level after waveform distortion. The impact caused by the RC delay to the control signal waveform can be clearly seen. The waveform at the end portion of the scan line is different from the front portion of the scan line. The situation becomes worse when the screen size of the LCD is increased. The control signal waveform at the end portion of the scan line requires more time to reach the voltage level, such as $V_{GH}$ and $V_{GL}$.

In order to turn off all TFTs on the scan line $G_n$ while the scan line $G_{n+1}$ is triggered, a gate output enable (GOE) signal is outputted from the gate driver IC to make sure that two neighboring scan lines will not be enabled simultaneously. The timing is shown in FIG. 4. Conventionally, a charging time, i.e., a clock pulse, for a scan line is $t_4$. If the GOE signal is applied, the charging time is reduced by $\Delta t$ and the actual charging time of the scan line is $t_5$. The higher the resolution of the LCD, the shorter the clock pulse $t_4$. In addition, the larger the screen size of the LCD, the longer the scan line, and the worse the RC delay. Accordingly, $\Delta t$ should be increased to avoid simultaneously enabling two neighboring scan lines.

With the trend of a large-size LCD screen with higher resolution, the charging time $t_4$ is reduced, and since $\Delta t$ should be kept at a certain interval, the actual charging time $t_5$ becomes shorter. Therefore, the charging time is insufficient. For manufacturing a large-size LCD with high resolution, the insufficient charging time would work against it.

Another issue when driving the LCD is the feed-through effect. This effect is shown by the formula below:

$$V_{feedthrough} = \frac{C_{GD}}{C_{GD} + C_{LC} + C_{st}} \Delta V,\ \Delta V = (V - V_{GL}) \tag{1}$$

In formula (1), $C_{GD}$ represents the stray capacitance between the gate and drain of the TFT, $C_{LC}$ represents the liquid crystal capacitance, $C_{st}$ represents the holding capacitance, and $\Delta V$ represents the voltage difference at the end of the control signal waveform.

FIG. 5 is a configuration showing a positive filed and a negative field. The voltage of the liquid crystal capacitor is charged to the desired voltage level during the turn-on period of the TFT, but the voltage is reduced by $\Delta V_a$ when the signal is cut off because of the stray capacitance $C_{GD}$ between the gate and drain of the TFT. The voltage reduction will cause voltage difference between the voltage over the liquid crystal capacitors and the common voltage $V_{com}$ in the positive and negative fields. The voltage difference would result in a flicker effect. The conventional method to resolve the issue is to adjust the common voltage $V_{com}$ so that the voltage difference between the voltages over the liquid crystal capacitors and the common voltage $V_{com}$ in the positive and negative fields are equal. The dotted line of FIG. 5 represents the adjusted common voltage $V'_{com}$. The flicker effect of displaying is thus prevented.

What stated above is an ideal situation. If all the liquid crystal subpixels have the same feed-through effect, the flicker effect can be effectively resolved by adjusting the common voltage $V_{com}$. However, during the manufacturing process, the feed-through effects on the liquid crystal subpixels are different. The improvement after adjusting the common voltage $V_{com}$ is limited. As shown in FIGS. 3A-3C and the formula (1), there is a voltage difference ΔV of the control signal waveforms at the front and end portions of the same scan line. The high voltage level $V_1$ of the distorted waveform is smaller than the high voltage level $V_{GH}$ of the control signal waveform. That is, the voltage difference $\Delta V_1$ between the high voltage level and the low voltage level of the control signal at the end portion of the scan line is smaller than the voltage difference $\Delta V_{GH}$ between the high voltage level and the low voltage level of the trigger signal at the front portion of the scan line. As a result, the feed-through voltage $V_{feedthrough}$ at the front portion of the scan line is different from the feed-through voltage $V_{feedthrough}$ at the end portion of the scan line. Even if the common voltage $V_{com}$ is adjusted, the voltage difference between the voltages over the liquid crystal capacitors and the common voltage $V_{com}$ at the end and the front portions of the scan line are still different. The flicker effect still remains.

Different from those two methods of resolving the flicker effect mentioned above, another conventional method provides a trimmed waveform to reduce the feed-through voltage effect. As shown in FIG. 6A, by using the trimmed waveform, the voltage difference ΔV between the high voltage level and the low voltage level at the end of the control signal waveform changes from $\Delta V_{GH}$ to $\Delta V'_{GH}$. Because of the reduction of the voltage difference ΔV at the end of the control signal waveform, the feed-through voltage effect is also reduced. This method, however, cannot prevent the waveform distortion effect caused by the RC delay on the scan line. As shown in FIG. 6B, due to the RC delay, the waveform at the end portion of the scan line rises slowly, which would result in different voltage level when the trimming operation is triggered. That is, the high voltage level $V_{GH}$ is higher than the high voltage level $V_2$ of the distorted waveform. Thus, the voltage level of the trimmed waveform is also different. Namely, the voltage difference $\Delta V'_{GH}$ between the high voltage level and the low voltage level is larger than the voltage difference $\Delta V'_2$ between the high voltage level and the low voltage level of the distorted waveform. According to FIGS. 6A and 6B, though the feed-through voltage effect can be reduced, voltage difference between the voltages at the end and the front portions of the scan line and the common voltage $V_{com}$ are still different. The flicker effect still cannot be resolved.

Accordingly, the LCD should be improved in some aspects. One is that the charging time of the liquid crystal capacitor should be increased. Another is that the RC delay on the scan line should be reduced so that the feed-through voltage $V_{feedthrough}$ at the front portion and end portion of the scan line can be substantially equal.

SUMMARY OF THE INVENTION

Accordingly, the present invention is directed to a driving method and a driving circuit of a liquid crystal display which can minimize the difference of the feed-through voltages at the front portion and the end portion of the same scan line to reduce the flicker effect during display.

The present invention is also directed to a driving method and a circuit of a liquid crystal display which can increase the charging time of the liquid crystal capacitor.

In order to achieve the objects above, the present invention provides a gate driving method for a liquid crystal display. The liquid crystal display comprises a plurality of scan lines. The gate driving method for the liquid crystal display starts by generating a gate driving signal. A correction signal is superposed to the gate driving signal to generate a corrected gate driving signal and to reduce a high voltage level of the gate driving signal. A polarity of the correction signal is opposite to a polarity of the gate driving signal. The corrected gate driving signal is outputted and the corrected gate driving signal is used to drive a corresponding scan line.

In the gate driving method described above, the gate driving signal is a positive voltage square wave, and the correction signal is a negative voltage square wave. In addition, the step of superposing the correction signal to the gate driving signal is executed near a declining edge of the gate driving signal.

According to an embodiment of the present invention, a gate driving method for a liquid crystal display is provided. The liquid crystal display comprises a plurality of scan lines. The gate driving method for the liquid crystal display starts by generating a gate driving signal. A trimming operation is performed to the gate driving signal to reduce a high voltage level of the gate driving signal. After the trimming operation, a correction signal is superposed to the trimmed gate driving signal to generate a corrected gate driving signal and to reduce the high voltage level of the gate driving signal. A polarity of the correction signal is opposite to a polarity of the trimmed gate driving signal. The corrected gate driving signal is outputted and the corrected gate driving signal is used to drive a corresponding scan line.

In the gate driving method described above, the gate driving signal is a positive voltage square wave, and the correction signal is a negative voltage square wave. The trimming operation is executed near the declining edge of the gate driving signal. It is preferred that the step of superposing the correction signal to the trimmed gate driving signal is executed immediately after the trimming operation.

According to an embodiment of the present invention, a method of generating a gate driving signal of a liquid crystal display is provided, whereby the gate driving signal can drive a scan line of the liquid crystal display. The method of generating the gate driving signal of the liquid crystal display starts by generating a positive voltage square wave signal having a high voltage level and a low voltage level. A negative voltage square wave signal is superposed to the positive voltage square wave signal at a first preset time before a declining edge of the positive voltage square wave signal to generate the gate driving signal.

In the gate driving method described above, the method further comprises performing a trimming operating to the gate driving signal at a second preset time before the declining edge of the positive voltage square wave signal to reduce the high voltage level of the gate driving signal, wherein the first preset time is after the second preset time. It is preferred that the step of superposing the negative voltage square wave signal is executed immediately after the trimming operation.

According to an embodiment of the present invention, a gate driver generates a gate driving signal to drive multiple scan lines of a liquid crystal display. The gate driver comprises a positive voltage square wave generation module to generate a positive voltage square wave signal having a high voltage level and a low voltage level; a negative voltage square wave generation unit to generate a negative voltage square wave signal; a superposing unit coupled to an output terminal of the positive voltage square wave generation module and an output terminal of the negative voltage square wave generation unit. The negative voltage square wave signal is superposed to the positive voltage square wave signal at a first preset time before a declining edge of the positive voltage square signal to generate the gate driving signal.

In the gate driver above, the gate driver may further comprise a trimming unit coupled to the positive voltage square wave generation module. The trimming unit performs a trimming operation to the gate driving signal at a second preset time before the declining edge of the positive voltage square wave signal to reduce the high voltage level of the gate driving signal, wherein the first preset time is after the second preset time.

According to the methods and structures of the present invention, a negative voltage square wave signal is used for correction before the gate driving signal with the positive voltage square wave is applied to the scan line. The corrected gate driving signal is then applied to the scan line. Because the negative voltage square signal is also affected by the stray capacitance and the stray resistance of the scan line, the difference of the high voltage level and the low voltage level at the declining edge of the gate driving signal on the same whole scan line will be substantially equal. As a result, the feed-through voltages are also equal. Not only can the flicker effect be substantially improved, but the charging time of the liquid crystal capacitor is also increased.

The above and other features of the present invention will be better understood from the following detailed description of the preferred embodiments of the invention that is provided in communication with the accompanying drawings.

DESCRIPTION OF SOME EMBODIMENTS

The technical feature of the present invention is to minimize difference of feed-through voltage of transistors on the same scan line so as to reduce the flicker effect during display. In the present invention, it is assumed that $C_{GD}/(C_{GD}+C_{LC}+C_{st})$ in the formula (1) is a constant. The voltage difference at the end of the driving signal is modified by merely adjusting $\Delta V$.

Since the inputted positive voltage square wave signal, i.e., the gate driving signal, would trigger the described issues in the conventional technology, the inputted negative voltage square wave signal would also be affected by the stray capacitance and resistance of the scan line when passing through. Accordingly, if a negative voltage square wave signal, i.e., a correction signal, is superposed to the positive voltage square wave signal to generate a corrected gate driving signal, the difference of voltage drops of the positive voltage square wave signal at the front and the end portions of the scan line will be reduced by superposing the negative voltage square signal. The following is a detailed description of superposing the negative voltage square wave signal.

Figure 1:
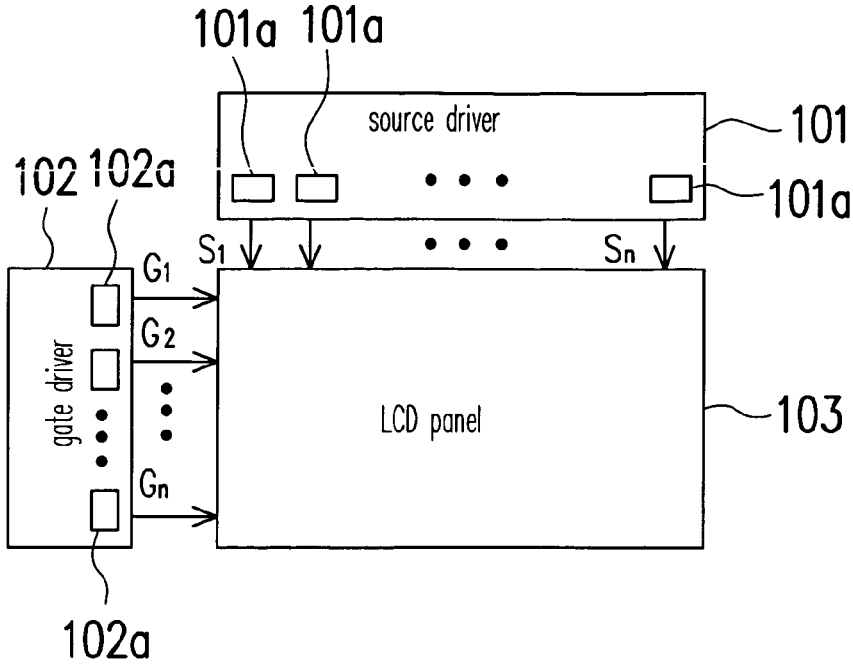
FIG. 1 (PRIOR ART)
FIG. 1 is a configuration showing a basic structure of an LCD.
Figure 2:
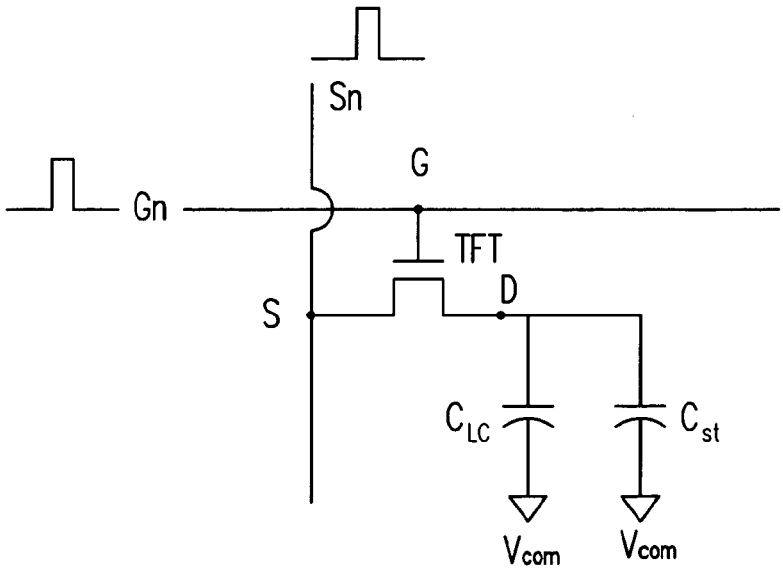
FIG. 2 (PRIOR ART)
FIG. 2 is a schematic configuration of a subpixel in an LCD panel.
Figures 3A, 3B, 3C:
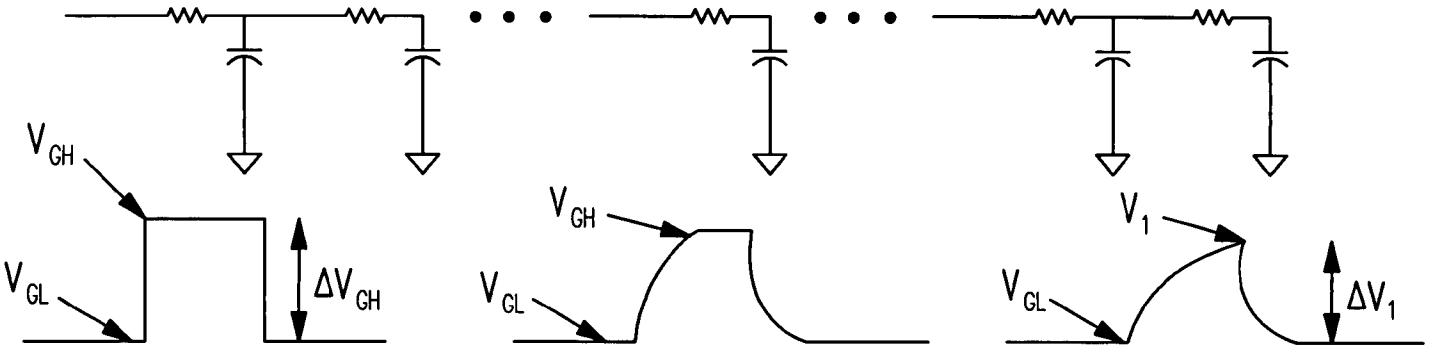
FIG. 3A (PRIOR ART)
FIG. 3B (PRIOR ART)
FIG. 3C (PRIOR ART)
FIG. 3A is a configuration showing a control signal waveform outputted from a gate driver IC of an LCD.
FIG. 3B is a configuration showing a distorted waveform after the influence of the stray capacitance and resistance on the scan line.
FIG. 3C is a configuration showing a waveform at the end portion of the scan line.
Figure 4:
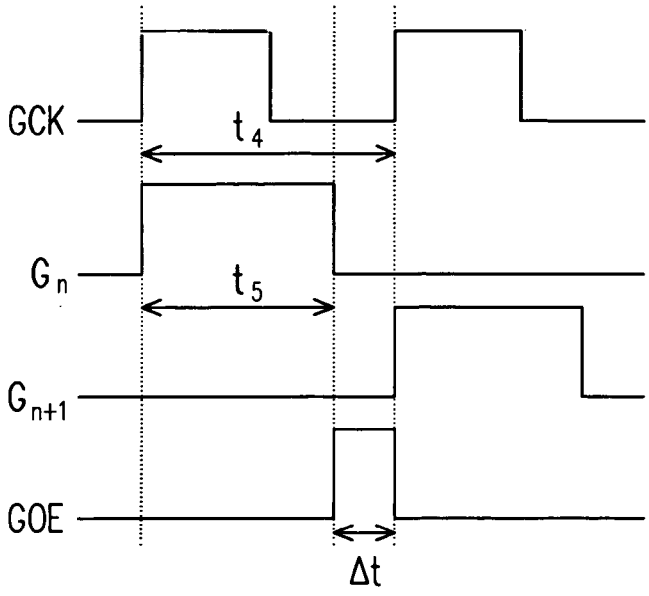
FIG. 4 (PRIOR ART)
FIG. 4 is a time sequence.
Figure 5:
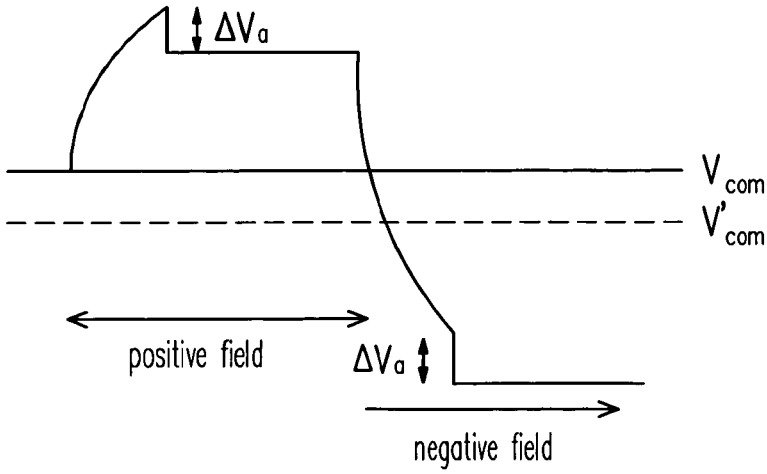
FIG. 5 (PRIOR ART)
FIG. 5 is a configuration showing a positive filed and a negative field.
Figure 6A:
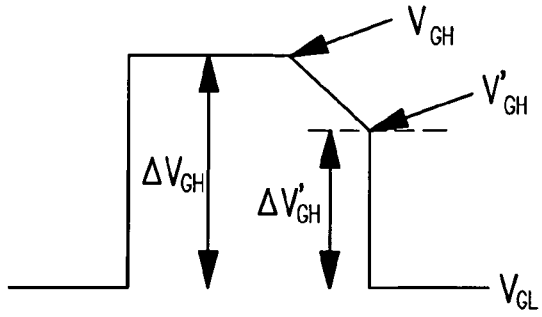
FIG. 6A (PRIOR ART)
FIG. 6A is a configuration showing a trimmed waveform.
Figure 6B:
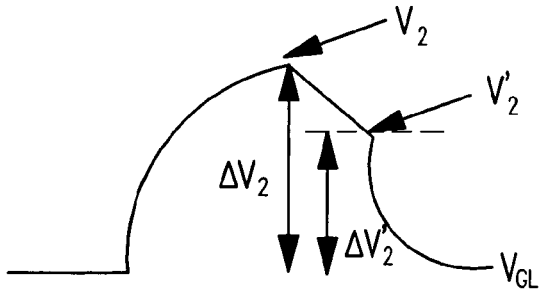
FIG. 6B (PRIOR ART)
FIG. 6B is a configuration showing a trimmed waveform at the end portion of a scan line.
Figure 7:
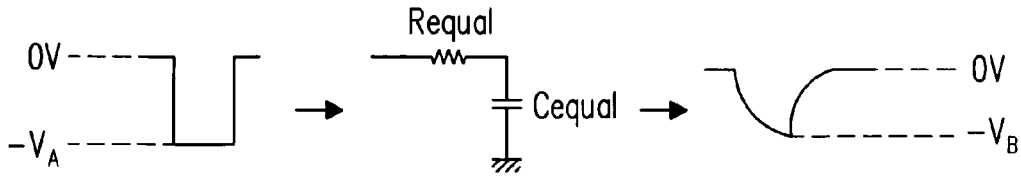
FIG. 7 is a schematic configuration showing a negative square waveform and a negative square waveform with RC delay.

FIG. 7 is a schematic configuration showing a negative square wave. If the stray resistance and the stray capacitance on the scan line are $R_{equal}$ and $C_{equal}$, respectively, due to the RC delay on the scan line, the waveform at the end of the scan line is show in the right side in FIG. 7. When the negative voltage square wave signal is applied to the liquid capacitor of the scan line, the voltage over the liquid capacitor would decline. The RC delay on the scan line would cause different voltages of the negative square signal on the front portion and end portion of the scan line. That is, the low voltage level $|V_A|$ of the negative voltage square wave signal at the front portion is larger than the low voltage level $|V_B|$ of the distorted negative voltage square wave signal at the end portion. Accordingly, when the negative voltage square wave is applied to the liquid crystal capacitor $C_{LC}$ of the scan line, the voltage drops at the end portion is smaller than that at the front portion of the scan line. Therefore, the voltage drops at the front and the end portion of the scan line are closer.

Figure 8:
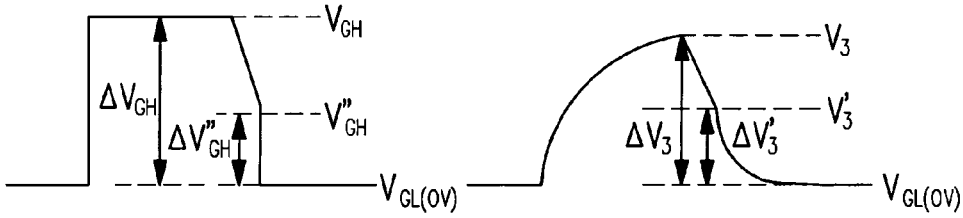
FIG. 8 is a schematic drawing showing a negative voltage square waveform superposed to a driving signal waveform.

FIG. 8 is a configuration showing a corrected voltage waveform by superposing a negative voltage square wave signal to a positive voltage square wave signal. Referring to the left figure in FIG. 8, it shows the front portion of the scan line. The timing of superposing the negative voltage square wave signal is before the high voltage level of the positive voltage square wave signal changes to the low voltage level $V_{GL}$, such as 0V. $\Delta V''_{GH}$ represents the voltage difference between the high voltage level and the low voltage level of the negative voltage square wave signal. If the negative voltage square wave signal in FIG. 7 is applied, the high voltage level $V_{GH}$ of the positive voltage square wave signal is pulled down to $V''_{GH}$ by the negative voltage $-V_A$ of the negative voltage square wave signal in FIG. 7. $\Delta V$ in formula (1) changes from $V_{GH}-V_{GL}$ to $V''_{GH}-V_{GL}=\Delta V''_{GH}$. In other words, $\Delta V$ is reduced by $V_{GH}-V''_{GH}$.

Referring to the right figure in FIG. 8, it shows the waveform at the end portion of the same scan line. The timing of superposing the negative voltage square wave signal is also before the high voltage level of the positive voltage square wave signal changes to the low voltage level $V_{GL}$, such as 0 V. $\Delta V'_3$ represents the voltage difference between the high voltage level and the low voltage level by superposing the negative voltage square wave signal to the distorted waveform. According to FIG. 8, when the negative voltage square wave signal of FIG. 7 is applied, the high voltage level $V_3$ of the positive voltage square wave signal at the end portion of the scan line is pulled down to $V'_3$ by the negative voltage $-V_B$ of the negative voltage square wave signal in FIG. 7. $\Delta V$ thus changes from $V_3-V_{GL}$ to $V'_3-V_{GL}=\Delta V'_3$. In other words, $\Delta V$ is reduced by $V_3-V'_3$.

By comparing the left and right figures in FIG. 8, the negative voltage square wave signal would also be affected by the stray capacitance and the resistance of the scan line so that the voltage drops at the front portion and the end portion of the scan line are different. Because the polarity of the negative voltage square wave signal is opposite to that of the positive voltage square wave signal, the amount of voltage $V_{GH}$ pulled at the front portion and that of $V_3$ pulled at the end portion of the scan line, respectively, are different. Therefore, the voltage drops $V_{GH}-V''_{GH}$ and $V_3-V'_3$ at the front portion and the end portion of the scan line, respectively, are also different.

Because the voltage $V_{GH}$ at the front portion of the scan line is higher than the voltage $V_3$ at the end portion, the voltage drops ΔV at the front portion and the end portion of the scan line are substantially equal. That is, ΔV (front portion) $=\Delta V''_{GH}=V''_{GH}-V_{GL}\approx\Delta V'_3=V'_3-V_{GL}=\Delta V$ (end portion).

In other words, when the driving voltage waveform is a square wave signal, and if the negative voltage square wave signal is superposed, the voltage difference $\Delta V''_{GH}$ between the high voltage level and the low voltage level at the front portion of the scan line is substantially equal to the voltage difference $\Delta V'_3$ between the high voltage level and the low voltage level at the end portion of the scan line of the distorted waveform. The feed-through voltages $V_{feedthrough}$ are also substantially equal. By adjusting the common voltage $V_{com}$, the voltage difference between the voltages over the liquid crystal capacitors and the common voltage $V_{com}$ on the same scan line are substantially equal in the positive and the negative fields. Thus, the flicker effect during display can be reduced.

Figure 9:
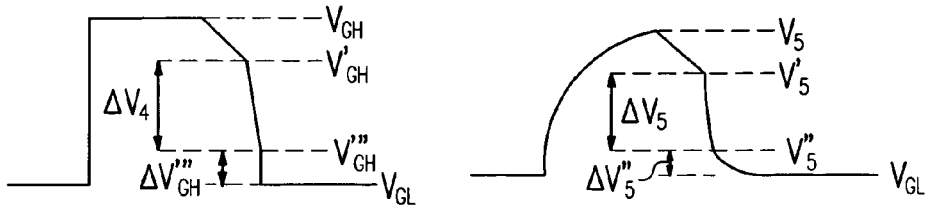
FIG. 9 is a configuration showing a negative voltage square waveform superposed to a trimmed waveform.

The present invention is not limited to superposing the negative voltage square waveform. FIG. 9 is another embodiment of the present invention. In this embodiment, a trimming operation is applied to the positive voltage square waveform of the gate driving signal. For the gate driving signal, the trimming operation performed to the positive voltage square wave signal is another approach to resolve the flicker issue in the conventional technology. In the conventional method, the voltage difference between the voltages over the liquid capacitors on the front portion and the end portion of the scan line and the voltage difference of the common voltage are still substantially different. Thus, the flicker effect in the conventional technology cannot be resolved. By applying the method of superposing the negative voltage square wave signal in the present invention, the feed-through voltages at the front portion and the end portion of the scan line can be substantially equal. The flicker effect during display can be prevented.

In FIG. 9, the trimming operation is executed before superposing the negative voltage square waveform. The left figure in FIG. 9 represents the waveform at the front portion of the scan line; the right figure in FIG. 9 represents the waveform at the end portion of the scan line. Referring to the left figure in FIG. 9, the driving signal, i.e., the positive voltage square wave signal, outputted from the gate driver, is trimmed. The high voltage level is reduced from $V_{GH}$ to $V'_{GH}$. After the trimming operation, the negative voltage square wave signal is superposed to reduce the high voltage level from $V'_{GH}$ to $V'''_{GH}$. When the negative voltage square signal of FIG. 7 is applied, the high voltage level $V'_{GH}$ of the trimmed positive voltage square wave signal is pulled down to $V'''_{GH}$ by the negative voltage $-V_A$ of the negative voltage square wave signal in FIG. 7. ΔV in formula (1) changes from $V'_{GH}-V_{GL}$ to $V'''_{GH}-V_{GL}=\Delta V'''_{GH}$. In other words, ΔV is reduced by $\Delta V_4=V'_{GH}-V'''_{GH}$.

The right figure in FIG. 9 represents the waveform at the end portion of the same scan line. The timing of superposing the negative voltage square wave signal is after the trimming operation to the high voltage level of the positive voltage square waveform. $\Delta V''_5$ represents the voltage difference between the high voltage level and the low voltage level of the distorted waveform by superposing the negative voltage square wave signal. In FIG. 9, when the negative voltage square wave signal of FIG. 7 is applied, the high voltage level $V'_5$ of the trimmed positive voltage square wave signal at the end portion of the scan line is pulled down to $V''_5$ by the negative voltage $-V_B$ of the negative voltage square wave signal in FIG. 7. ΔV in the formula (1) thus changes from $V'_5-V_{GL}$ to $V''_5-V_{GL}=\Delta V''_5$. In other words, ΔV is reduced by $\Delta V_5=V'_5-V''_5$.

By comparing the left and right figures in FIG. 9, the negative voltage square wave signal is also affected by the stray capacitance and the resistance of the scan line so that the voltage drops on the front portion and the end portion of the scan line are different. Because the polarity of the negative voltage square wave signal is opposite to that of the positive voltage square wave signal, the amount of voltage of trimmed $V'_{GH}$ pulled at the front portion and that of trimmed $V'_5$ at the end portion of the scan line, respectively, are different. The voltage drops $\Delta V_4$ and $\Delta V_5$ at the front portion and the end portion of the scan line, respectively, are also different. Because the voltage $V'_{GH}$ at the front portion of the scan line is larger than the voltage $V'_5$ at the end portion, the voltage drops ΔV at the front portion and the end portion of the scan line are substantially equal. That is, ΔV (front portion) $=\Delta V'''_{GH}=V'''_{GH}-V_{GL}\approx\Delta V''_5=V''_5-V_{GL}=\Delta V$ (end portion).

In other words, if the driving voltage waveform is a square waveform, if the trimming operation is performed to the driving voltage waveform, and if the negative voltage square signal is superposed, the voltage difference $\Delta V'''_{GH}$ between the high voltage level and the low voltage level at the front portion of the scan line is substantially equal to the voltage difference ΔV"5 between the high voltage level and the low voltage level at the end portion of the scan line after distortion. The feed-through voltages $V_{feedthrough}$ are substantially equal. By adjusting the common voltage $V_{com}$, the voltage differences between the voltages over the liquid crystal capacitors and the common voltage $V_{com}$ on the same scan line are substantially equal. The flicker effect during display can be reduced.

According to the descriptions above, the negative voltage square wave signal is superposed to the gate driving signal, i.e., the driving signal waveform, outputted from the gate driver. Next, whether the trimming operation is executed to the gate driving signal, the voltage drops ΔV at the front portion and the end portion of the scan line are substantially equal. Because the feed-through voltage $V_{feedthrough}$ is proportional to the voltage drop ΔV at the end of the driving signal waveform, the feed-through voltages $V_{feedthrough}$ at the front portion and the end portion of the scan line are substantially equal. Accordingly, the flicker effect during display can be effectively resolved.

The method described above can be implemented by coupling a negative voltage square wave generator to the gate driver. For the trimming operation, a circuit which can perform the trimming operation can be coupled to relevant circuits. For example, the circuit for generating the negative voltage square wave signal and the circuit for performing the trimming operation can be coupled to the conventional gate driver. In addition, the circuit may comprise a superpose circuit to superpose the positive voltage square wave signal and the negative voltage square wave signal to generate the corrected gate driving signal.

Another disadvantage of the liquid crystal display is the insufficiency of charging time. The present invention can also resolve the issue. The following is a description of increasing charging time according to the present invention.

Figure 10:
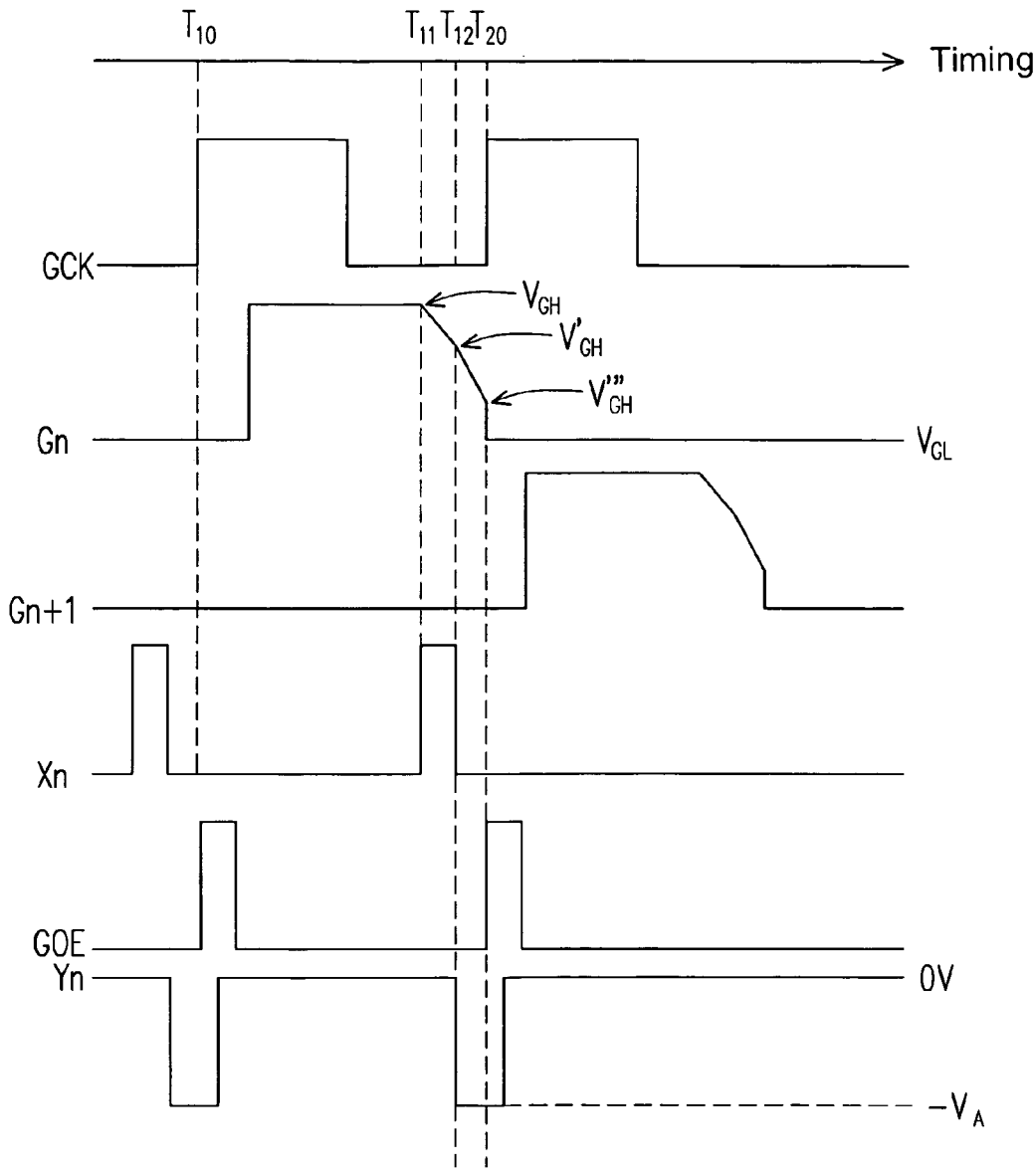
FIG. 10 is a timeing diagram of generation and output of a gate driving signal according to the present invention.

FIG. 10 is a timing diagram of generation and output of a gate driving signal according to the present invention. Referring to FIG. 10, it comprises all signal waveforms described above. Wherein, GCK represents the clock waveform of the gate driver IC, $X_n$ represents the signal to trigger the trimming operation, and $Y_n$ represents the signal to trigger the negative voltage waveform. As shown in FIG. 10, after the time T10 of the clock waveform GCK, the gate driver outputs the gate driving signal with the high voltage level $V_{GH}$ to the $n^{th}$ scan line $G_n$. At the time T11, according to the inclining edge of the signal $X_n$ for triggering the trimming operation, the trimming operation is executed to the gate driving signal. With a constant slope rate, the high voltage level $V_{GH}$ is pulled down to $V'_{GH}$. At the time T12, which is the declining edge of the signal $X_n$ for triggering the trimming operation, the trimming operation is finished, while the signal $Y_n$ for triggering the negative voltage waveform appears. At the time T12, the negative voltage waveform is superposed to the trimmed waveform, and the level $V'_{GH}$ is pulled down to $V'''_{GH}$. At the time T20, the voltage difference is $V'''_{GH}-V_{GL}$. At the time T20, the gate output enable signal GOE is outputted. After the output of the signal GOE, the steps described above are repeated to drive the next scan line $G_{n+1}$.

According to the method described above, the negative voltage square waveform is triggered while the signal $X_n$ for trimming operation is going to be finished. After the gate output enable signal GOE is triggered, the negative voltage square waveform keeps working. Accordingly, when the voltage level of the thin film transistor on the scan line declines from the high voltage level $V_{GH}$ to the low voltage level $V_{GL}$ of driving signal waveform, the low voltage level $V_{GL}$ of the driving signal waveform is a negative voltage and the current direction is the same as the direction of the negative voltage square waveform. The negative voltage square waveform will enhance the current speed. As a result, the voltage level can come to the low voltage level $V_{GL}$ of driving signal waveform at a faster speed. The delay effect caused by the RC delay can be reduced. The signal length of the gate output enable signal GOE in the conventional technology to avoid triggering two neighboring scan lines can be also shortened. The charging time of the liquid crystal capacitor of the liquid crystal display is thus increased. Therefore, the present invention can solve the insufficient charging time of the liquid crystal display in prior art.

Figure 11:
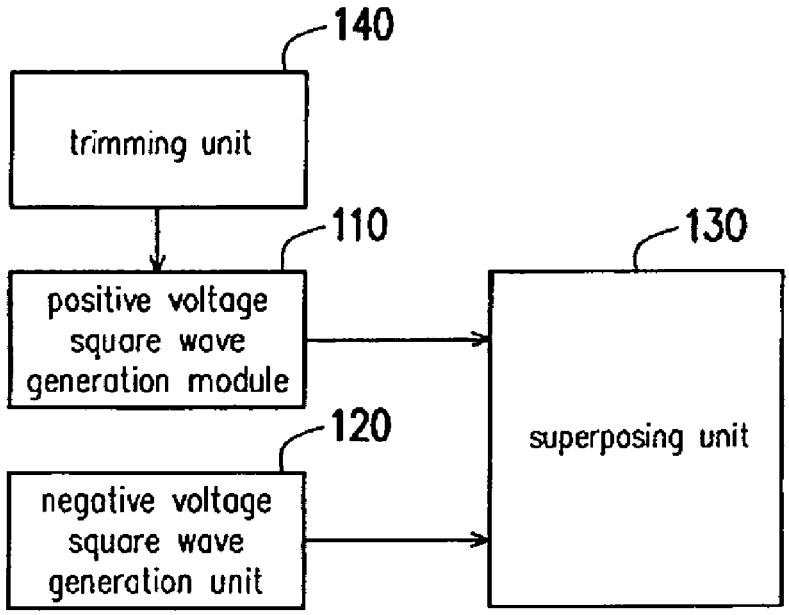
FIG. 11 is a block diagram of a gate driver according to the present invention.

FIG. 11 is a block diagram of gate driver according to the present invention.

Referring to FIG. 11, the gate driver generates a gate driving signal to drive multiple scan lines of a liquid crystal display (not drawn in FIG. 11) and includes a positive voltage square wave generation module 110, a negative voltage square wave generation unit 120, a superposing unit 130 and a trimming unit 140. The positive voltage square wave generation module 110 generates a positive voltage square wave signal having a high voltage level and a low voltage level. The negative voltage square wave generation unit 120 generates a negative voltage square wave signal. The superposing unit 130 is coupled to an output terminal of the positive voltage square wave generation module 110 and an output terminal of the negative voltage square wave generation unit 120. The negative voltage square wave signal is superposed to the positive voltage square wave signal at a first preset time before a declining edge of the positive voltage square wave signal to pull down the high voltage level of the positive voltage square wave signal by a negative voltage level of the negative voltage square wave signal. Then, the superposing unit 130 generates the gate driving signal according to the superposing result. The trimming unit 140 performs a trimming operation to the gate driving signal at a second preset time before the declining edge of the positive voltage square wave signal to reduce the high voltage level of the gate driving signal, wherein the first preset time is after the second preset time. Accordingly, the present invention uses a negative voltage square waveform to reduce the flicker effect during display and increase the charging time of the liquid crystal capacitor.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A gate driving method for a liquid crystal display, the liquid crystal display comprising a plurality of scan lines, the gate driving method for the liquid crystal display comprising:

providing an independent gate driving signal to drive one of the corresponding scan lines;

performing a trimming operation to the independent gate driving signal before a voltage level of the independent gate driving signal is switched from a high voltage level to a low voltage level, so that the voltage level of the independent gate driving signal declines from the high voltage level to a first voltage level which is between the high voltage level and the low voltage level of the independent gate driving signal_according to a first slope; and providing an independent correction signal to said one of the corresponding scan lines after the trimming operation is completed and before a next independent gate driving signal is provided to a next corresponding scan line, so that the voltage level of the independent gate driving signal declines from the first voltage level to a second voltage level which is between the first voltage level and the low voltage level_according to a second slope, wherein the voltage level of the independent gate driving signal declines from the second voltage level to the low voltage level according to a third slope before the next independent gate driving signal is provided to the next corresponding scan line, wherein the first slope, the second slope and the third slope are different from each other, and wherein said one of the corresponding scan lines is continuously driven by the declined gate driving signal until a gate output enable signal is provided for generating the next gate driving signal, a polarity of the independent correction signal is opposite to a polarity of the independent gate driving signal, the high voltage level is greater than the first voltage level, the first voltage level is greater than the second voltage level, the second voltage level is greater than the low voltage level, the gate driving signal is a positive voltage square wave, and the correction signal is a negative voltage square wave.

2. The gate driving method for the liquid crystal display of claim 1, wherein the independent correction signal is provided to said one of the corresponding scan lines immediately after the trimming operation is completed.

3. A gate driver to generate a gate driving signal to drive multiple scan lines of a liquid crystal display, the gate driver comprising:

a positive voltage square wave generation module to generate an independent positive voltage square wave signal;

a negative voltage square wave generation unit to generate an independent negative voltage square wave signal;

a trimming unit coupled to the positive voltage square wave generation module, the trimming unit performing a trimming operation to the independent positive voltage square wave signal at a first preset time before a declining edge of the independent positive voltage square wave signal to reduce a high voltage level of the independent positive voltage square wave signal to a first voltage level which is smaller than the high voltage level and greater than a low voltage level of the independent positive voltage square wave signal according to a first slope; and an superposing unit coupled to an output terminal of the positive voltage square wave generation module and an output terminal of the negative voltage square wave generation unit, wherein the superposing unit outputs the independent positive voltage square wave signal to one of the corresponding scan lines, and then outputs the independent negative voltage square wave signal to said one of the corresponding scan lines at a second preset time before the declining edge of the independent positive voltage square wave signal and before a next positive voltage square wave signal is provided to a next corresponding scan line, so as to pull down the high voltage level of the independent positive voltage square wave signal from the first voltage level to a second voltage level which is smaller than the first voltage level and greater than the low voltage level according to a second slope, wherein the second preset time is after the first preset time, wherein the voltage level of the independent positive voltage square wave signal declines from the second voltage level to the low voltage level according to a third slope before the next positive voltage square wave signal is provided to the next corresponding scan line, and wherein the first slope, the second slope and the third slope are different from each other.

* * * * *